US005458161A

United States Patent [19]

Scarfe

[11] Patent Number: 5,458,161

[45] Date of Patent: Oct. 17, 1995

[54] HIGH LOOP DENSITY PIN SEAM

[75] Inventor: Alfred Scarfe, Stone Mountain, Ga.

[73] Assignee: JWI Ltd., Kanata, Canada

[21] Appl. No.: 331,621

[22] PCT Filed: Mar. 14, 1994

[86] PCT No.: PCT/CA94/00142

§ 371 Date: Nov. 9, 1994

§ 102(e) Date: Nov. 9, 1994

[87] PCT Pub. No.: WO94/21847

PCT Pub. Date: Sep. 29, 1994

Related U.S. Application Data

[63] Continuation-in-part of Ser. No. 34,579, Mar. 19, 1993, abandoned.

[51] Int. Cl.[6] ..... D03D 3/04

[52] U.S. Cl. ..... 139/383 AA

[58] Field of Search ..... 139/383 AA

[56] References Cited

U.S. PATENT DOCUMENTS

| | | | |
|---|---|---|---|
| 803,659 | 11/1905 | Allen . | |
| 2,255,452 | 9/1941 | Pink . | |
| 2,903,021 | 9/1959 | Holden et al. . | |
| 3,366,355 | 1/1968 | Haller . | |
| 3,596,858 | 8/1971 | Curtis . | |
| 3,700,194 | 10/1972 | MacBean . | |
| 4,026,331 | 5/1977 | Lees et al. . | |
| 4,035,872 | 7/1977 | MacBean . | |
| 4,182,381 | 1/1980 | Gisbourne . | |
| 4,286,631 | 9/1981 | Strandly . | |
| 4,346,138 | 8/1982 | Lefferts . | |
| 4,438,789 | 3/1984 | MacBean . | |
| 4,469,142 | 9/1984 | Harwood . | |
| 4,535,824 | 8/1985 | Kerber et al. . | |
| 4,945,612 | 8/1990 | Talonen . | |
| 4,991,630 | 2/1991 | Penven . | |
| 5,062,216 | 11/1991 | Hannigan . | |
| 5,089,324 | 2/1992 | Jackson | 139/383 AA |
| 5,092,373 | 3/1992 | Lee . | |
| 5,188,884 | 2/1993 | Smith . | |

FOREIGN PATENT DOCUMENTS

| | | |
|---|---|---|
| 0185907 | 7/1986 | European Pat. Off. . |
| 2286235 | 4/1976 | France . |
| 9104374 | 4/1991 | WIPO . |
| 9119044 | 12/1991 | WIPO . |

*Primary Examiner*—Andy Falik
*Attorney, Agent, or Firm*—Robert A. Wilkes

[57] ABSTRACT

A pin seam for use in woven papermaking fabrics, wherein more than 50% of the warp strands from each of the fabric ends are used to form the pintle retaining loops. The loops formed at one of the opposing fabric ends have an "S" orientation, while the loops formed at the second opposing end have a "Z" orientation, thereby allowing the two sets of pintle retaining loops to interdigitate easily. The resulting seam is strong, easily installed on the papermaking machine and has a reduced propensity to mark the paper web. The invention is particularly applicable to fabrics woven using 3-shed weave patterns or integral multiples thereof.

6 Claims, 5 Drawing Sheets

HIGH LOOP DENSITY PIN SEAM

CROSS-REFERENCE TO RELATED APPLICATION

This is a continuation-in-part of application Ser. No. 08/034,579, filed Aug. 19,1993 abandoned.

BACKGROUND OF THE INVENTION (a) Field of the Invention

The present invention relates to an improved, high strength, high loop density, woven back pin seam for use in joining the ends of papermakers' and like fabrics.

(b) Description of the Prior Art

Woven fabrics, intended for use in either the forming, pressing or drying sections of paper making machines, are usually rendered endless by one of three methods:

1) endless weaving, such as is described in U.S. Pat. No. 2,903,021;

2) joining the opposing ends of a flat woven fabric with a permanent seam, such as is described in U.S. Pat. No. 3,366,355; U.S. Pat. No. 3,596,858 or U.S. Pat. No. 3,700,194; or 3) joining the opposing ends of a flat woven fabric by forming small loops in the opposing fabric ends and then interdigitating these loop ends during installation of the fabric on the papermaking machine to form a passageway through which a pintle is inserted to form a hinge-type joint. Such seams are described, for example, in U.S. Pat. No. 4,182,381, U.S. Pat. No. 4,469,142 and U.S. Pat. No. 5,092,373.

The present invention is concerned with the last of these methods. Although several types of these seams are presently in use on papermaking fabrics, the most desirable type of seam, which produces the least mark in the paper web in contact with it, is a woven back pin seam, wherein the warps of the fabric are used to form the loops which receive the joining pintle. The loops are formed by weaving back the ends of some of the warps into a nearby warp path in the fabric, in registration with the fabric weave. Such seams are well known in the prior art, and are referred to in the trade, and henceforth in this disclosure, as pin seams.

Because of their length, dryer fabrics are almost always joined on the paper machine with an on-machine seam, and therefore this invention applies particularly to dryer fabrics. However, press fabrics are also often joined by pin seams, as are some coarse forming fabrics, and the invention applies equally well to these types of fabrics.

It is well known that most prior art pin seams are formed in fabrics woven in 4-shed or 8-shed weave patterns. Such designs are particularly well suited to pin seaming due to their even number of sheds. The pin seam is typically made by removing a predetermined number of weft strands from each end of the fabric and when reweaving the crimped warp strands, which now project from both fabric ends, through a plurality of added weft, in a manner that is well known. The weft strands are generally chosen from a group consisting of thermoplastic polymer monofilaments, spun yarns, multifilament yarns, plied monofilaments, or combinations thereof. A warp strand is typically folded back and interwoven partway into a nearby warp path until it reaches the warp strand normally residing in that path, which is also rewoven into the added weft strands. Both strands are clipped off closely to the surface of the fabric to provide termination points at various distances from the last original undisturbed weft strand in the fabric end. One-half of these folded back warp strands are bent around a loop-forming rod placed adjacent the last added weft strand to form pintle loops. The remaining folded back warp strands are bent around the last added weft to form non-load bearing loops. The same method is employed at the opposing fabric end so as to produce seaming loops which are identical to those made at the first fabric end. The seam is then closed by interdigitating the two sets of pintle loops, and inserting the pintle. It will thus be seen that only 50% of the available warp strands from each opposing fabric end are used to form the load bearing pintle loops in these prior art pin seams.

Prior art pin seams suffer from several disadvantages, including, but not limited to the following:

1) the difficulty with which the fabric ends are interdigitated and the pintle inserted during installation on the paper machine, 2) fabric failures due to insufficient strength in the region of the seam, and 3) marking of the moist paper web by the seam.

Ease of installation is a very important feature of pin-seamed fabrics. If a lengthy time is required to install a fabric on a large paper machine due to difficulties encountered during interdigitation of the pintle loops, or insertion of the pintle across the fabric width, then the cost to the paper maker in terms of machine down-time can be great. Numerous attempts have been made to improve the ease by which the seam is formed and the pintle inserted into fabrics which are rendered endless during their installation on the paper making machine; U.S. Pat. No. 4,035,872 and U.S. Pat. No. 4,945,612 provide examples of various methods devised to improve or assist the interdigitation of the opposing ends of the fabric, and simplify insertion of the pintle by providing a more open pin-receiving channel. U.S. Pat. No. 4,469,142, for example, discloses a pin seam having enlarged seaming loops with the objective of overcoming these problems.

It is well known that the seam is a weak point of the fabric, and seam failures are commonplace in all papermaking fabrics. Thus, it is also very desirable to provide a pin seam whose tensile strength is as near to that of the fabric itself as is possible. As previously noted, most prior art pin seams are made in 4- or 8-shed fabrics in which one-half of the fabric warp yarns are used to form pintle retaining loops at each opposing end of the fabric. This is equivalent to a 50% loop fill. The term "loop fill" is used henceforth to denote that percentage of the total available number of warp yarns at each end of the fabric which are used to form the pintle retaining loops. A 50% loop fill was thought to be necessary to permit the loops from the opposing fabric ends to interdigitate easily while providing an open passageway for the closing pintle, thereby reducing fabric installation time. Because the remaining 50% of the available warps are not load bearing elements in the seam, the tensile strength of such seams cannot exceed 50% of the fabric strength.

As used herein, warp fill is defined as the amount of warp in a given space relative to the total space considered. Warp fill can be over 100% when there are more warp strands jammed into the available spaces than the space can dimensionally accommodate in a single plane. Fabrics having a nominal warp fill of approximately 100% will generally have an actual calculated warp fill of from 80% to 120%, as do the fabrics of the present invention. Values over 100% are brought about by crowding and lateral undulation of the warp strands.

It is desirable that the seam not mark the paper which is being formed upon it. Seam marking can be caused in the dryer section by differential drying rates resulting from changes in air permeability in the seam area when compared to the body of the fabric, or by excessive pressure of any raised portions of the seam against the wet paper web as it is being held against a dryer cylinder. In any case, it is well known that a pin seam having relatively short pintle retaining loops, which is closed with a pintle of the proper size, will reduce any marking tendency. In general, the seam should provide as little difference as possible, with regard to both air permeability and thickness, When compared to the remainder of the fabric. A compromise between the requirements of non-marking and tensile strength is often required in order to provide a seam which can be quickly and easily installed in the fabric on the paper machine.

Numerous means have been proposed to optimize the above noted seaming requirements Of non-marking, strength and ease of installation. For example, Lees, in U.S. Pat. No. 4,026,331, discloses a woven back pin seam for use in single layer forming fabrics having warp fill greater than 86%. The patent teaches that seam marking may be reduced by selecting appropriate fabric weave structures and yarn diameters which will ensure that the thickness of both the fabric and seam are approximately the same. The seam is formed by unweaving the opposing fabric ends and then when reweaving folding back the loop forming warp yarns so that their crimp is in registration with the fabric crimp pattern. However, it is disclosed that this latter requirement restricts application of the method to symmetrical weave patterns (col. 4, lines 47–56). The seam utilizes 50% of the available warp yarns to form the load bearing pintle loops, thus its tensile strength cannot exceed 50% of the fabric tensile strength. The patent is silent with respect to the angular orientation of the seaming loops.

In U.S. Pat. No. 4,991,630, Penven discloses a 100% loop fill pin seam for use in single warp layer woven press felt base fabrics. The pintle loops at the opposing fabric ends are formed so as to be oppositely inclined to one another. heatsetting the fabric will allegedly then cause the pintle loops to be realigned so as to take on a substantially orthogonal orientation with respect to the pintle, thereby permitting easy seam closure. Those skilled in the art will realize that the 100% loop fill seam disclosed by Penven, as well as the prior art shown in FIG. 1 of the patent, can only be achieved if the warp fill of the fabric is less than 50%, otherwise there will be insufficient room at the seam to intermesh the pintle loops. Both FIG. 1 and FIG. 4 of Penyen show fabrics which appear to have a low warp fill. In contrast, the warp fill of the fabrics of the present invention must be from about 80% to about 120%. Therefore, the Penven disclosure and prior art are not relevant to the present invention, although the 100% loop fill seam is a desirable goal. Research by the present inventor has shown that it is possible to form a high loop fill seam for use in a high warp fill fabric without the attendant disadvantages of the prior art noted by Penven.

Prior to the present invention, manufacturers of paper machine clothing were unable to produce reliably woven back pin seams in fabric designs having odd numbers of sheds, such as 3-shed designs, and integral multiples thereof, such as 6-shed designs. MacBean, in U.S. Pat. No. 4,438,789, describes a pin seam in which 66⅔% of the available warp strands are used to form pintle retaining loops in a high warp fill fabric having a 6-shed, semi-duplex, asymmetrical weave design. This patent recognized the difficulty of interdigitating a 66⅔% loop fill seam and sought to solve the problem by forcing the loops into an erect position by means of supplementary multifilament yarns which are interwoven around pairs of warp loops, forcing them together into an orthogonal position to improve loop alignment, and to facilitate loop interdigitation. The main features of this patent are as follows:

i) the seam may be formed without rotating the warp yarns at the loops (col. 3, lines 15–17), ii) all of the projecting warp strands forming the pintle and retaining loops are woven back without regard to their pre-set crimp configuration or the crimp pattern of the fabric (col. 3, lines 24–26), and iii) selected pairs of pintle loops are grouped to form tandem loops with intervening retaining loops so that two-thirds of the available warp strands are formed into pintle loops (col. 4, lines 21–27), which are then drawn together by means of supplementary flexible strands to facilitate their. intermeshing and pintle insertion (col. 4, lines 28–36).

One objective of this patent was to provide a high strength seam in which 66⅔% of the warp yarns are used to create the pintle loops. The key feature of MacBean is that flat monofilament warp yarns, which form the pintle and retaining loops, are re-woven back into the fabric without regard to their pre-set crimp configuration or the crimp pattern of the fabric.

The MacBean seam presents both the papermaker and paper machine clothing manufacturer with a number of practical disadvantages. First, in order to make a 66⅔% loop fill seam in fabrics of this weave design, the seaming loops must be formed in pairs, thus requiring two pintle loops at one fabric end to fit into a space occupied by one retaining loop formed by one warp yarn at the second fabric end. Second, an extra manufacturing step is required to weave in the supplementary flexible strands which are needed to hold the pairs of seaming loops upright and in alignment so that the pintle can be inserted during fabric installation. Third, in order to form the disclosed two-thirds loop fill seam with its pairs of equal sized pintle loops, at least one of the warp strands of each pair must be rewoven in mis-registration with the preset crimp pattern of the fabric, thus causing an unacceptable roughness at the seam. So far as Applicant is aware, this seam design is not used commercially.

If a prior art, 50% loop fill pin seam is formed in a 3-shed weave, the result will be unsatisfactory. Although the length of warp yarn forming each pintle retaining loop is the same, the-3-shed weave pattern dictates that adjacent loop-forming yarns must each begin at different starting points in the fabric. Then, either the loops will project outwardly different distances from the fabric ends to form an irregular seam, or the warp yarns cannot be rewoven so as to maintain their crimp in registration with that of the fabric weave pattern. Thus, 3-shed and 6-shed weaves have not commonly been used in fabrics where pin seams are required, despite the usefulness of some of these weaves.

Similarly, if the prior art teachings of Lees or Penyen, for example, are applied in a 66⅔% loop fill seam such as disclosed by MacBean, the result will also be unsatisfactory. Lees and MacBean contradict one another regarding the necessity of reweaving the warp yarns from the seam in registration with the fabric weave. Penven and MacBean agree insofar as both advocate the use of orthogonal pintle loops to facilitate pintle insertion. However, Penven relies upon heatsetting to reorient the inclined pintle loops into an orthogonal position, while MacBean uses supplementary yarns to achieve the same end. It will also be appreciated that neither the seam described by Penven as prior art, nor the disclosed seam, both of which are 100% loop fill seams, could be practiced in fabrics whose warp fill exceeds 50% because they would be difficult or impossible to close.

Thus, prior art seam constructions have not been entirely satisfactory in certain applications for a variety of reasons. A need still exists in the paper making industry for a dryer fabric containing a woven back pin seam which offers, in combination, the following features:

i) high tensile strength, approaching that of the fabric, ii) low profile, so as not to mark the web formed thereon, and iii) ease of installation on the paper machine.

It is particularly desirable that such a seam be applicable to fabrics woven in 3-sheds, or integral multiples thereof, wherein the warp yarns forming the pintle retaining loops are rewoven in registration with the fabric weave pattern.

SUMMARY OF THE INVENTION

The present invention seeks to overcome the aforementioned difficulties of the prior art by providing a woven dryer fabric, for use in the dryer section of a paper making machine, said fabric having a first and second end which are joined by a pin seam including a pintle and pintle retaining loops, wherein in the fabric:

a) the warp yarns are polymeric monofilaments woven at a warp fill of from about 80% to about 120%, and, b) the warp yarns from which the pintle retaining loops are formed at the first and second fabric ends are rewoven into the fabric so that their preset crimp is maintained in registration with that of the fabric weave pattern, and further wherein in the pin seam:

i) the pintle retaining loops have a loop fill greater than 50%, ii) the pintle retaining loops are each formed from a length of warp yarn which is no greater than two and one-half repeats of the fabric weave, iii) the pintle retaining loops on the first fabric end have an "s" orientation, and iv) the pintle retaining loops on the second fabric end have a "z" orientation.

These novel features improve the ease with which the pintle retaining loops along the fabric ends are interdigitated, and provide a smoother and more open passageway for insertion of the pintle. As a consequence, the resulting seam is easier to install on the papermaking machine. The improved interdigitation of the pintle retaining loops, and their high loop fill, reduces the propensity of these novel seams to mark the webs being formed upon them, while increasing the tensile strength of the seam. The relatively short pintle retaining loops preferably comprise a length of warp yarn that is no greater than two and one-half repeats of the fabric weave. The resulting seam is surprisingly easy to close, despite the high loop fill and relatively short loop length. Seams manufactured in accordance with the teachings of this invention are especially useful in dryer fabrics, but seams in other types of fabrics, such as those intended for the forming or pressing sections of papermaking machines, will benefit equally well from the features of this invention.

The letters "S" and "Z" are used henceforth to describe the direction of rotation used to form the pintle retaining loops about the central axis of the pintle. A pintle retaining loop is said to have an "S" orientation around the pintle if, when the seam is held in a vertical position, the portion of the loops facing the observer, comprising the warp yarns rotated about the pintle, incline in the same direction as the central portion of the letter "S". Similarly, the pintle retaining loops of the seam are said to have a "Z" orientation around the pintle if, when the seam is held in a vertical position, the portion of the loops facing the observer, comprising the Warp yarns rotated about the pintle, incline in the same direction as the central portion of the letter "Z". This designation is similar to that used in the textile industry to describe the direction of twist imparted to yarns and related products, and has been adapted from international standard ISO 2-1973 (E).

The principle upon which the improved interdigitation of the pintle retaining loops of the present invention rests is somewhat similar to that employed in the formation of spiral fabrics. Such fabrics are assembled by arranging a multiplicity of helices in parallel relationship to one another, with alternate helices being wound in opposite "S" and "Z" directions, so that they are capable of interdigitation. Spiral fabrics are disclosed, for example, by Allen in U.S. Pat. No. 803,659 Pink in U.S. Pat. No. 2,255,452, and more recently by Lefferts, in U.S. Pat. No. 4,346,138, and by Kerber, in U.S. Pat. No. 4,535,824. Although the interdigitation of these spiral fabrics bears some similarity, the present invention differs from a spiral fabric in that it is a seam which is formed in a woven fabric having a warp fill of approximately 100%.

The present invention has particular application in 3-shed woven fabrics, or an integral multiple of a 3-shed weave, such as 6- and 9-shed weaves, although other designs may benefit equally from these novel techniques. Fabrics which must be thin and contain a low or non-marking seam, such as those intended for single tier or serpentine dryer sections, substantially as described in U.S. Pat. No. 5,062,216, will benefit particularly from the pin seam of this invention, but the invention is not so limited.

BRIEF DESCRIPTION OF THE DRAWINGS

The invention will now be described, by way of example, with reference to the accompanying drawings which illustrate two embodiments of the invention. In all of the accompanying drawings, the letter "A" indicates one of the ends of the fabric to be joined, the letter "B" indicates the second, opposing fabric end, and the letter "P" denotes a pintle.

In FIGS. 3, 7, 10, 14 and 15, the pintle is omitted, and the A and B fabric ends separated for clarity.

DESCRIPTION OF THE ILLUSTRATED EMBODIMENTS

Figure 1:
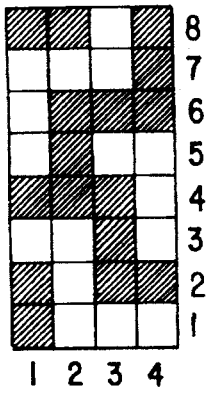
FIG. 1 depicts a weave diagram for a prior art 4-shed, 8 repeat dryer fabric.
Figure 12:
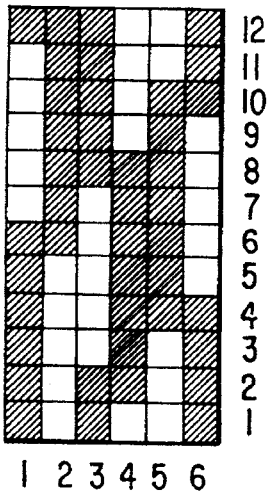
FIG. 12 depicts a weave diagram for a 6-shed, 12 repeat, asymmetric weave dryer fabric.

FIGS. 1 through 4 illustrate an example of a prior art 4-shed, 8 weft repeat woven fabric, commonly used as a paper machine dryer fabric, in which a woven back pin seam of the prior art has been made. This type of pin seam is frequently used to join the ends of symmetric fabrics woven using 4-shed patterns or integral multiples thereof. FIG. 1 is the weave diagram of this dryer fabric. The warp yarns are numbered 1 through 4, and are vertically aligned; the weft yarns are numbered 1 through 8, and are aligned horizontally. In this diagram, a solid square at the intersection of a warp and weft yarn indicates that the numerically identified warp yarn is woven over the numerically identified weft yarn; conversely, an empty square at the intersection of a warp and weft yarn indicates that the warp yarn is woven under the weft yarn. These conventions are also used in FIGS. 5 and 12.

Figure 2:
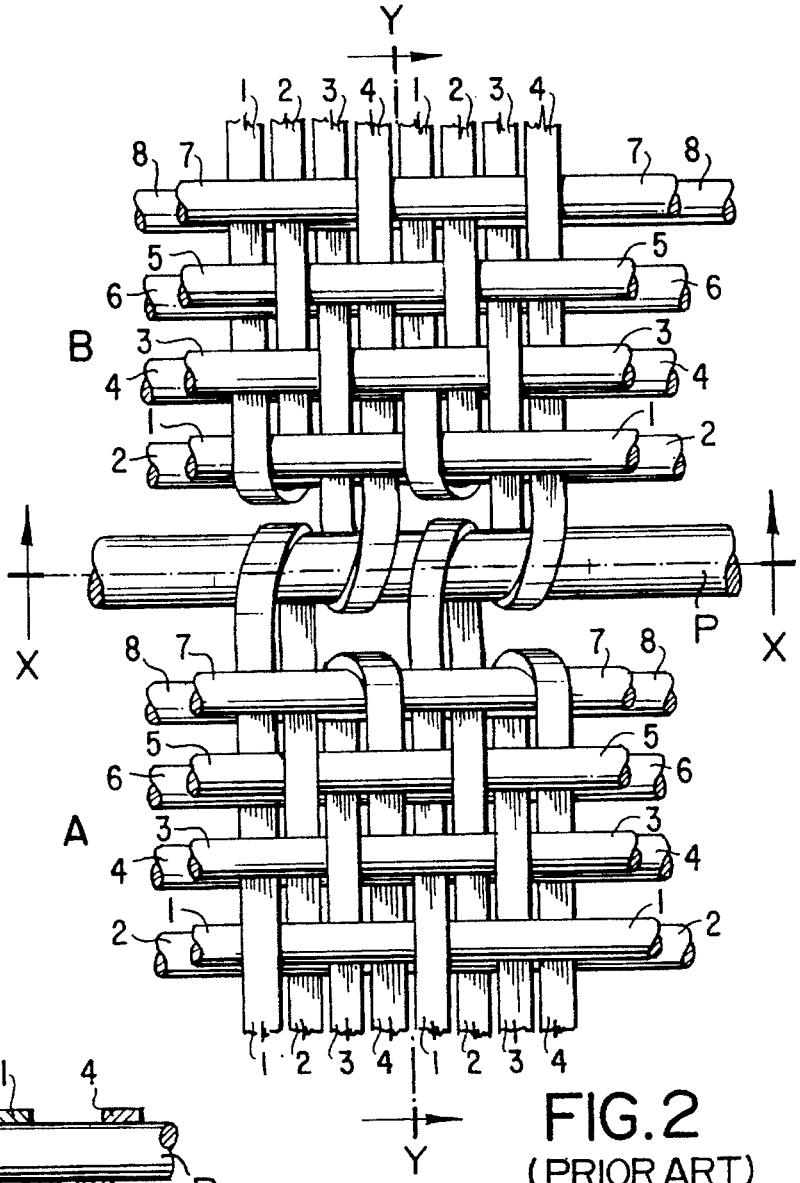
FIG.2 (PRIOR ART)
FIG. 2 is a plan view of the paper side of the fabric of FIG. 1, including a pin seam of the prior art.

FIG. 2 is an illustration of the paper side surface of a dryer fabric constructed in accordance with the weave diagram shown in FIG. 1, and in which a woven back pin seam of the prior art has been made between the opposing first and second ends of the fabric. From this diagram, it will be noted that the visible portion of each pintle retaining loop from both the A and B fabric ends is formed about the pintle P with an "S" orientation. This is a consequence of preparing both fabric ends for the pin seam in the identical fashion, in accordance with prior art techniques, as has been previously described. It will be appreciated that the pintle retaining loops at both fabric ends could also have been formed with a "Z" orientation, however, regardless of the direction in which these loops are oriented about the pintle, it has been common-practice in the prior art to prepare the opposing ends of woven fabrics for the pin seam in an identical fashion. The opposing fabric ends, and the pintle retaining loops therein, are thus identical to one another.

Fifty percent of the available warp yarns are used to form the pintle retaining loops in the prior art seam shown in FIG. 2, thus the seam is said to have a 50% loop fill. The tensile strength of a 50% loop fill woven back pin seam cannot exceed 50% of the tensile strength of the fabric itself.

Figure 3:
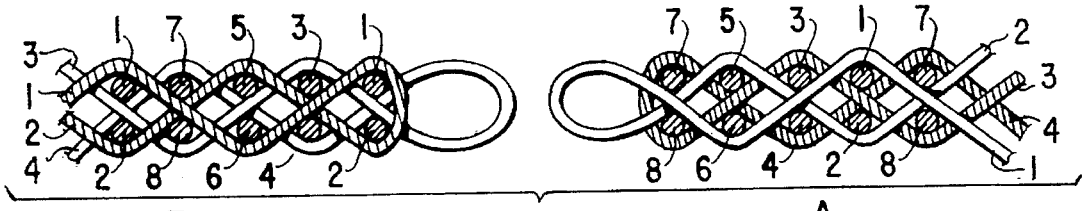
FIG.3 (PRIOR ART)
FIG. 3 is a side view along line Y—Y of FIG. 2, perpendicular to the plane of the fabric.

FIG. 3 is a sideview on line Y—Y in FIG. 2 of the fabric ends A and B, illustrating the prior art method by which the pintle retaining loops and non-load bearing yarn loops are formed. Starting with fabric end B shown in FIG. 3, it will be seen that warp 1, a non-load bearing yarn, is woven over wefts 1, 2 and 8, under wefts 7, 6, 5 and 3, then over wefts 4, 1 and 2, so as to wrap about wefts 1 and 2 to retain them in place behind the pintle and pintle retaining loops at the fabric end. Warp 1 is then woven back into the next adjacent position, that of warp path 2, forming a non-load bearing loop, passing under wefts 1, 2 and 3, over wefts 4, 5, 6 and 8, and under wefts 7, 2 and 1. The woven back portion of warp 1 is terminated in the path of warp yarn 2 at a predetermined distance from the pin seam in the body of the fabric, in a manner that is well known to those skilled in the art.

Warp yarn 3, a load bearing yarn, is woven over weft 2 and under wefts 1, 7, 8 and 5, over wefts 6, 3, 4 and 2 then under weft 1, whereupon it exits fabric end B to form a pintle retaining loop. Warp yarn 3 is then returned into the path of warp yarn 4, passing again over weft 2, under wefts 1, 3, 4 and 5, and over wefts 6, 7, 8 and 2. The woven back portion of warp yarn 3 is terminated in the path of warp yarn 4 as described above.

The pintle retaining loops in fabric end A shown in FIG. 3 are similarly constructed: warp yarn 2 is woven under wefts 7, 1, 2 and 3, then over wefts 4, 5, 6 and 8, whereupon it exits the fabric end A to form a pintle retaining loop. Warp yarn 2 is then returned into the fabric along the path of warp yarn 1, passing under wefts 7, 6, 5 and 3, over wefts 4, 1, 2 and 8, and under weft 7 to repeat the pattern.

Warp yarn 4, a non-load bearing yarn, is woven over wefts 7, 8 and 2, under wefts 1, 3, 4 and 5, and over wefts 6 and 7, whereupon it is wrapped around wefts 7 and 8 to retain them in place behind the pintle and pintle retaining loops at the fabric end, forming a non-load bearing loop. Warp yarn 4 is then returned into the fabric in the path of warp yarn 3, passing under wefts 7, 8 and 5, over wefts 6, 3, 4 and 2, and under wefts 1, 7 and 8 to repeat the pattern.

Figure 4:
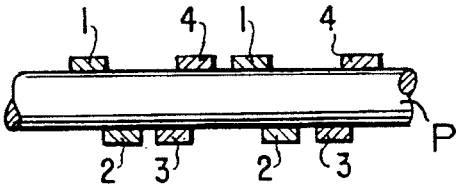
FIG.4 (PRIOR ART)
FIG. 4 is a section on line X—X of FIG. 2, perpendicular to the plane of the fabric.

FIG. 4 is a section taken through the pintle P along line X—X shown in FIG. 1 perpendicular to the plane of the fabric, illustrating the orientation of the pintle retaining loops from the opposing ends of the fabric with respect to one another after insertion of the pintle P. From this diagram, it may be seen that the pintle retaining loops formed by warps 1 and 2 from fabric end A all appear as canted to the left, while the loops formed by warps 3 and 4 from fabric end B all appear as canted to the right. This pattern of alternate orientation is repeated along the length of the pintle P and is a direct consequence of forming the pintle retaining loops on both opposing ends A and B of the fabric with the same "S" orientation. This configuration causes the pintle retaining loops from the opposing fabric ends A and B to crowd each other alternately along the paper side and machine side of the pintle P. This crowding increases the difficulty of interdigitating the opposing fabric ends A and B in this 50% loop fill seam, but not excessively so.

Figure 5:
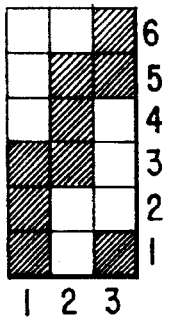
FIG. 5 depicts a weave diagram for a prior art 3-shed, 6 repeat dryer fabric.

FIGS. 5 through 8 illustrate an example of a 3-shed, 6 weft repeat woven dryer fabric in which a 66⅔% high loop fill, woven back pin seam has been formed using prior art methods. The weave diagram of this fabric is shown in FIG. 5.

Figure 6:
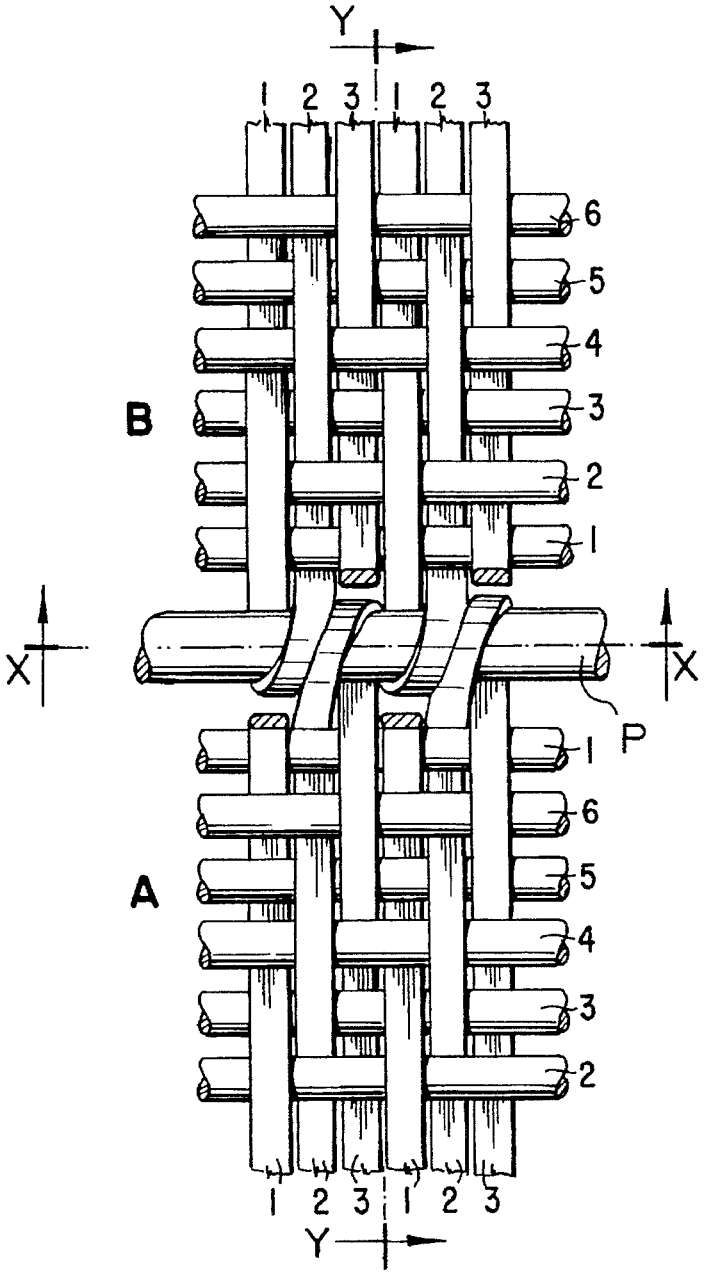
FIG.6 PRIOR ART
FIG. 6 is a plan view of the paper side surface of the fabric of FIG. 5, including a prior art 66⅔% loop fill pin seam.

FIG. 6 is an illustration of the paper side of a fabric woven in accordance with the weave diagram shown in FIG. 5, in which a prior ark high loop fill, woven back pin seam has been formed. This diagram is provided to illustrate the result of producing a high loop fill woven back pin seam in a 3-shed fabric using prior art methods. It will be seen that the visible portion of each pintle retaining loop from both fabric ends A and B about the pintle P has an "S" orientation. This is a consequence of preparing both fabric ends A and B for the pin seam in the identical manner, as previously discussed. The loops from both opposing ends could also have been formed with a "Z" orientation, however, regardless of, the direction in which these loops are oriented around the pintle, both fabric ends A and B are prepared in exactly the same manner, in accordance With accepted techniques of the prior art, and are identical to one another.

It will also be noted that every third warp yarn, 3, from fabric end B, and every third warp yarn, 1, from fabric end A, is a non-load bearing yarn which has been terminated at the seam face. Thus, 66⅔% of the warp yarns on each opposing fabric end are used to form the pintle retaining loops, resulting in a high tensile strength, 66⅔% loop fill seam. As a consequence of both their orientation and high loop fill, the pintle retaining loops are crowded together. Each loop tightly fills the space made available by the corresponding warp yarn from the opposing fabric end which has been terminated facing that loop. This crowding of the pintle retaining loops at the pintle is caused by the "S" orientation imparted to all of the loops from both fabric ends A and B.

Figure 7:
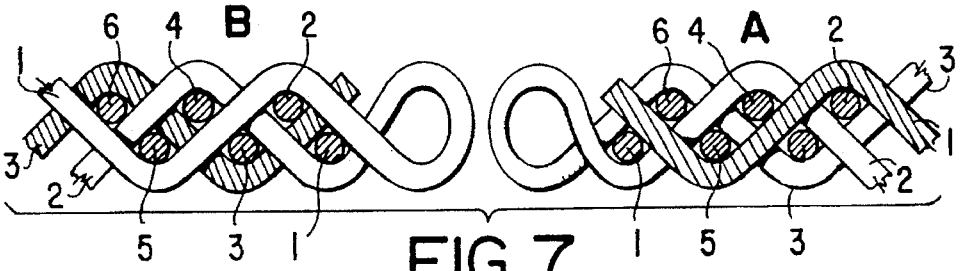
FIG.7 PRIOR ART
FIG. 7 is a side view along line Y—Y of FIG. 6, perpendicular to the plane of the fabric.

FIG. 7 is side view along line Y—Y in FIG. 6 of this fabric as it has been prepared for a woven back pin seam. Starting with fabric end B, shown in FIG. 7, warp passes under wefts 6, 5 and 4, and over wefts 3, 2 and 1, whereupon it forms a pintle retaining loop, and is then woven back into the fabric into the adjacent warp position 2. The yarn passes under wefts 1 and 2, over wefts 3, 4 and 5 and under weft 6. The woven back portion of warp 1 is terminated in the path of warp yarn 2 at a predetermined distance from the pin seam in a manner that is well known to those skilled in the art. The next adjacent yarn, 3, a nonload bearing yarn, passes over wefts 6 and 5, and under wefts 4, 3 and 2 whereupon it is terminated over weft 1 so as to provide space to accommodate the pintle retaining loop from the opposing fabric end.

Turning now to fabric end A, it will be seen that warp 3, a load bearing yarn, passes under wefts 2, 3 and 4, and then over wefts 5, 6 and 1, whereupon it exits fabric end A to form a pintle retaining loop. Warp 3 is then woven back into the path of the adjacent warp 2, and passes under wefts 1 and 6, over wefts 5, 4 and 3, and then under weft 2. The woven back portion of warp 3 is terminated in the path of warp yarn 2 at a predetermined distance in the manner previously described.

Figure 8:
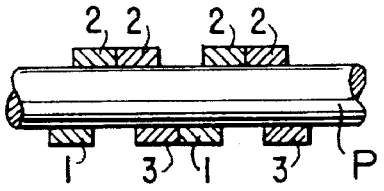
FIG.8 PRIOR ART
FIG. 8 is a section on line X—X of the fabric of FIG. 6; perpendicular to the plane of the fabric.

FIG. 8 is a section taken through the pintle P along line X—X shown in FIG. 6, perpendicular to the plane of the fabric, illustrating the position of the pintle retaining loops from the opposing fabric ends A and B with respect to one another after interdigitation and insertion of the pintle P. From FIG. 8 it may be seen that the loops formed by warps 2 and 3 from fabric end A are all canted to the left of FIG. 8, while the loops formed by warps 1 and 2 from fabric end B are canted to the right. This pattern is repeated along the length of the pintle P and is a direct consequence of forming the pintle retaining loops on both opposing fabric ends A and B with an "S" orientation. This configuration causes the loops from the opposing ends of the fabric to alternately, crowd each other along the paper and machine sides of the pintle P. The resultant crowding of the pintle retaining loops in this 66 ⅔% loop fill design makes the seam extremely difficult to close on the paper machine.

Figure 11:
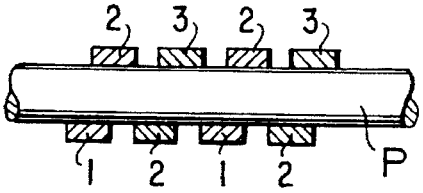
FIG. 11 is a section on line X—X of the fabric of FIG. 9, perpendicular to the plane of the fabric.
Figure 9:
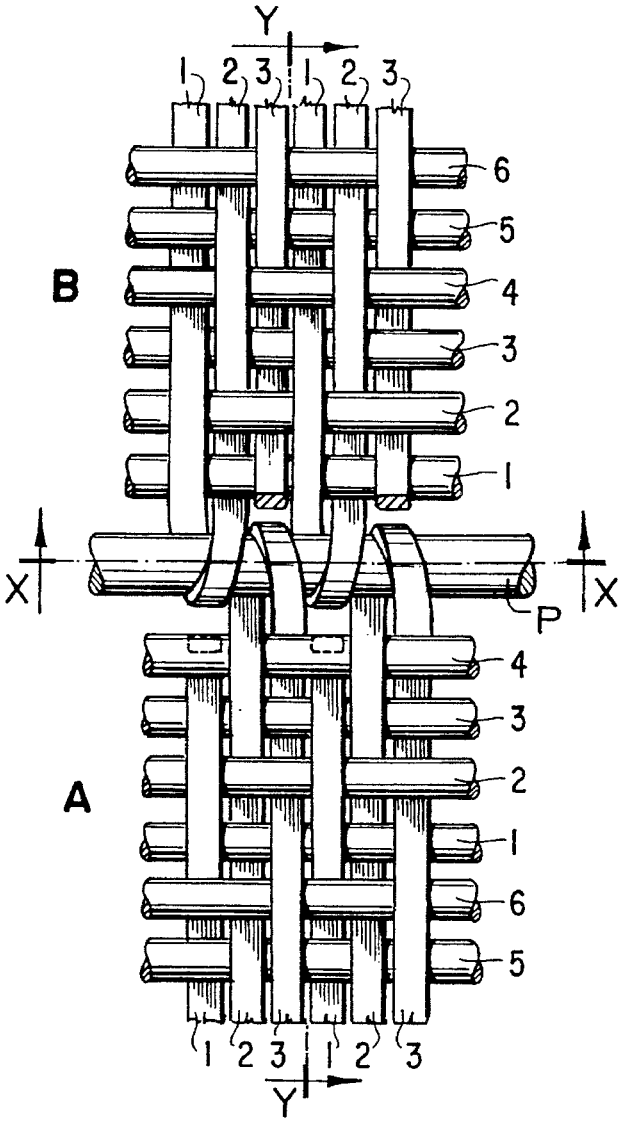
FIG. 9 is a plan view of the paper side surface of a fabric woven according to the weave diagram of FIG. 5, including a pin seam according to the present invention.
Figure 10:
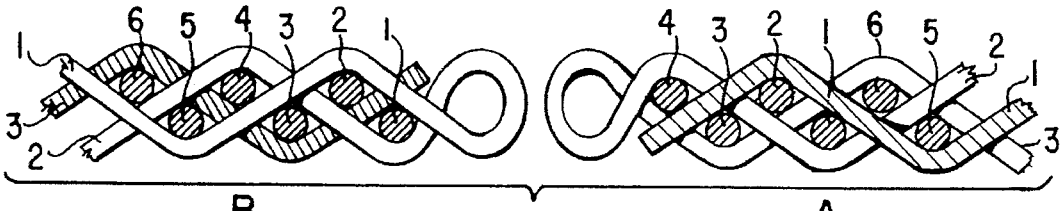
FIG. 10 is a side view along line Y—Y of the fabric of FIG. 9, perpendicular to the plane of the fabric.

FIGS. 9 through 11 illustrate a preferred embodiment of the present invention, which seeks to overcome these aforementioned problems. In these Figures, a 66⅔% loop fill pin seam according to the present invention, having relatively short pintle retaining loops, is formed in a 3-shed, 6-repeat fabric woven according to the weave diagram of FIG. 5.

FIG. 9 is an illustration of the paper side of a fabric woven according to the weave diagram of FIG. 5, in which a 66⅔% loop fill, woven back pin seam, formed in accordance with the teachings of the present invention, has been produced. Every third warp yarn, 3, from fabric end B, and every third warp yarn, 1, from fabric end A, is a nonload bearing yarn terminated at the fabric end. Pintle retaining loops on fabric end B are formed by returning warp 1 into the path of warp 2, while the pintle retaining loops on fabric end A are formed by returning warp 3 into the path of warp 2, thus utilizing 66⅔% of the warp yarns from each opposing end to form the loops at a 66⅔% loop fill. The pintle retaining loops on fabric end B shown in FIG. 9 are identical to those in fabric end B in FIG. 6, and all of the pintle retaining loops on fabric end B are thus oriented in the "S" direction. However, the pintle retaining loops from fabric end A are formed with a "Z" orientation.

FIG. 10 is a side view of fabric ends A and B of the fabric shown in FIG. 9 as prepared for a high loop fill, woven back pin seam according to the present invention. Referring first to fabric end A in FIG. 10, it will be seen that warp 3, a load bearing yarn, is woven over wefts 5, 6 and 1, and under wefts 2, 3 and 4, whereupon it exits the end of the fabric to form the pintle retaining loop. In this instance, however, and in comparison to the path and loop formed by warp 1 in fabric end B as described above, warp yarn 3 passes over then under the pintle P to then return into the path of warp yarn 2 in such a manner that the pintle retaining loop is formed with a "Z" orientation. Warp 3 is then woven over wefts 4 and 3, under wefts 2, 1 and 6, and then over weft 5 as it proceeds along the path of warp 2 and is terminated at some distance back from the face of the seam.

The consequence of forming the pintle retaining loops on the opposing fabric ends with opposite "S" and "Z" orientations is that all of the loops from both fabric end A and fabric end B are canted in the same direction when interdigitated along the pintle P, as shown in FIG. 11.

It is these opposing "S" and "Z" oriented pintle retaining loops which allow for the easy interdigitation of this novel, high loop density pin seam. The warp yarns forming the pintle-retaining loops of the prior art seam, shown in FIG. 8, were crowded, and the seaming loops canted in opposite directions along the pintle P. As can be seen in FIG. 11, the pintle retaining loops from each opposing fabric end are now all canted in the same direction, and are not crowded, thus enabling the loops to interdigitate easily.

Furthermore, because the loops are canted in the same direction along the pintle, with no excess space between them, there is less discontinuity at the seam, thus reducing the propensity of this novel seam to mark the paper web being formed upon it. Seam marking is further reduced by using lengths of warp yarn that are no greater than the length of two and one-half repeats of the fabric weave, to produce relatively short pintle retaining loops. These loops extend from and terminate at the last inserted weft 4 or 1 at the fabric ends A and B as shown in FIG. 10. The high loop fill of this seam also provides a smooth track through the pintle loops which allows rapid insertion of the pintle P during fabric installation.

FIGS. 12 through 16 illustrate a second preferred embodiment of the present invention in which a high strength, high loop density pin seam has been formed in a 6-shed, 12 repeat non-symmetric dryer fabric. The weave diagram of this fabric is graphically represented in FIG. 12.

Figure 14:
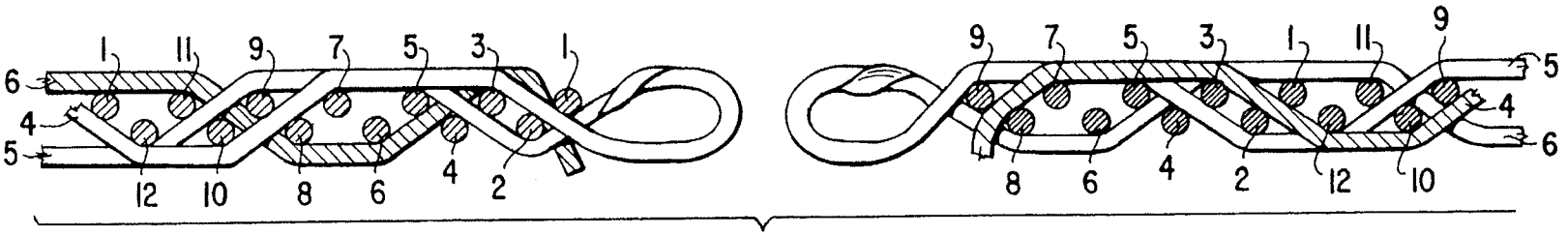
FIG. 14 is a side view along line Z—Z of FIG. 13, perpendicular to the plane of the paper.
Figure 15:
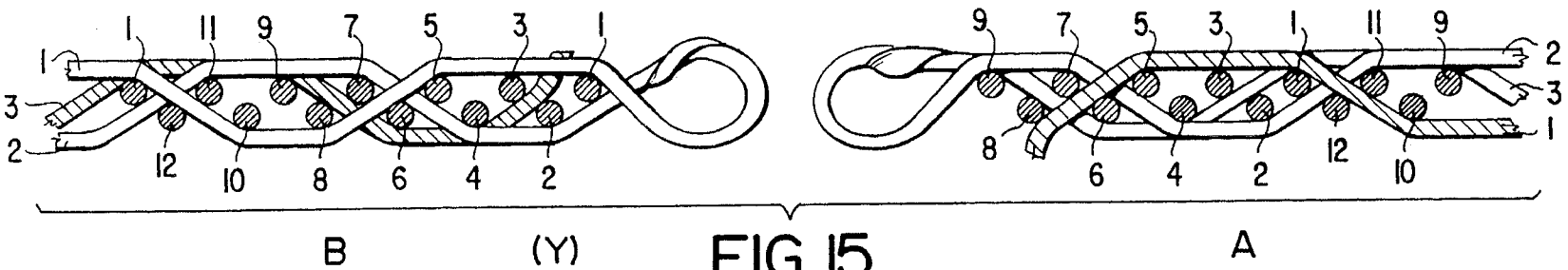
FIG. 15 is a side view along line Y—Y of FIG. 13, perpendicular to the plane of the paper.

Because this is a 6-shed weave, the paths of warps 1, 2 and 3 from fabric ends A and B are shown in FIG. 15, while the corresponding paths of warps 4, 5 and 6 from, again, fabric ends A and B are shown separately in FIG. 14. In both of these Figures, the paper side is uppermost. Both FIGS. 14 and 15 are side views of the end portions of this 6-shed, 12 repeat fabric as prepared for a woven back pin seam of the present invention.

Turning first to fabric end B shown in FIG. 15, it may be seen that warp 1, a load bearing yarn, passes over wefts 1 and 12, under wefts 11–7, and over wefts 6–1 whereupon it exits the body of the fabric and is twisted about its longitudinal axis and returned into the fabric into warp path 2, forming a pintle retaining loop. Because this is a non-symmetric weave, the warp yarn 1 must be twisted 180° about its longitudinal axis so as to render the crimp of this yarn compatible with that of warp 2 so that it may be re-woven into the fabric. Warp yarn 1 then passes under wefts 1–5 and over wefts 6–12; this same pattern is repeated throughout the length of the fabric. The woven back portion of warp yarn 1 is terminated in the path of warp 2 at a predetermined distance from the pin seam in manner that is known to those skilled in the art. Warp yarn 3, a non-load bearing yarn, is woven over wefts 1 and 12–8, then under wefts 7–3, and over weft 2, and is terminated on the paper side of the fabric between wefts 3 and 1.

Warp 1 from fabric end A is a non-load bearing yarn; it is woven under wefts 9–11, over wefts 12 and 1–6, and is terminated on the machine side of the fabric between wefts 6 and 8. Warp 3, a load bearing yarn, is woven over wefts 9–12, 1 and 2, under wefts 3–7, and over wefts 8 and 9, whereupon it exits the seam face and is twisted 180° about its longitudinal axis and returned into the body of the fabric in the path of warp yarn 2, forming a pintle retaining loop. Warp 3 then passes back over wefts 9–6, under wefts 5–1, and over wefts 12–9 and is terminated in the path of warp 2 some distance removed from the seam. It will be noted that the pintle retaining loop formed by warp 3 has a "Z" orientation, while the pintle retaining loop formed by warp 1 from fabric end B has an "S" orientation. This may be seen more clearly in FIG. 13.

Turning now to warp yarns 4, 5 and 6 in fabric end B shown in FIG. 14, it will be seen that warp 4, a load bearing yarn, is woven under wefts 1 and 12–9, over wefts 82 and under weft 1. It exits the seam face, forming a pintle retaining loop, and is then twisted 180° about its longitudinal axis so as to render the crimp of warp yarn 4. compatible with that of warp 5 into which path it is inserted. Warp yarn 4 then passes under wefts 1–3, over wefts, 4–10 and under wefts 11, 12 and 1. Warp yarn 4 is terminated in the path of warp 5 in the manner previously discussed. Warp 6, a non-load bearing yarn, passes over wefts 1 and 12–10, under wefts 9–5, over wefts 4–2, and is terminated on the machine side of the fabric between wefts 2 and 1.

Referring now to fabric end A shown in FIG. 14, warp 4, a non-load bearing yarn, passes under wefts 9–12 and 1, over wefts 2–8 and is terminated on the machine side of the fabric between wefts 8 and 9. Warp 6, a load bearing yarn, is woven under weft 9, over wefts 10–12 and 1–4, and under wefts 5–9, whereupon it exits the face of the fabric to form a pintle retaining loop. It is also twisted 180° about its longitudinal axis so that the crimp of this yarn will be compatible with that of warp 5 into which path it is inserted. Warp yarn 6 is then woven back into the body of the fabric over wefts 9–4, under wefts 3–1, 12 and 11, and over wefts 10 and 9 as the weave pattern is repeated.

It will be noted that the pintle retaining loop formed by warp 6, from fabric end A, as it is brought around the pintle and returned into the path of warp 5 has been formed with a "Z" orientation, while the pintle retaining loop formed by warp 4, from fabric end B, as it is brought about the pintle P and returned into the path of warp 5, has been formed with an "S" orientation. This may be seen more clearly in FIG. 13.

Figure 13:
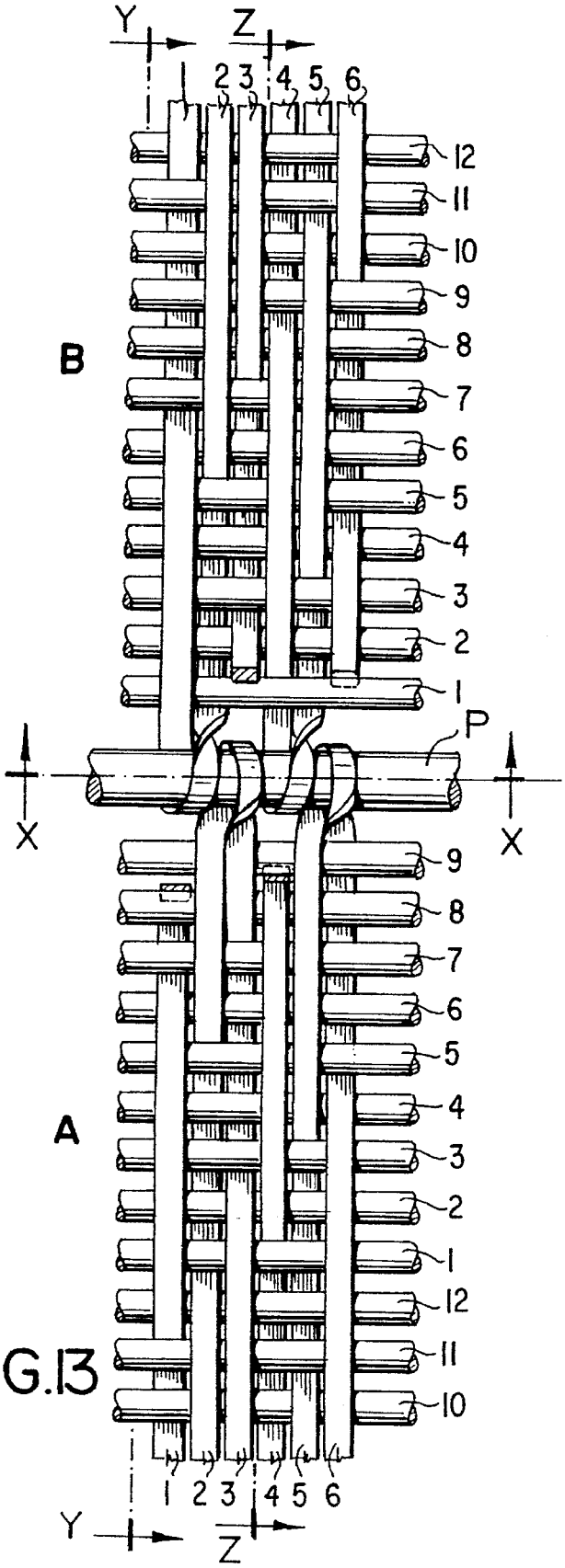
FIG. 13 is a plan view of the paper side surface of the fabric of FIG. 12, and including a pin seam according to the present invention.

FIG. 13 illustrates a plan view of the paper side surface of the pin seam area of this fabric, manufactured in accordance with the teachings of the invention. In this figure, it may be clearly seen that the opposite "S" and "Z" orientations of the pintle retaining loops from each of the opposing ends A and B of the fabric causes all of the loops to be canted in the same direction along the pintle P and eliminates their crowding, thereby allowing them to be easily interdigitated. This is more clearly seen in FIG. 16. The 180° twist imparted to the loop forming yarns, which is required so as to bring their crimp into registration with that of the yarns into whose paths they are inserted, has not adversely affected their alignment.

Figure 16:
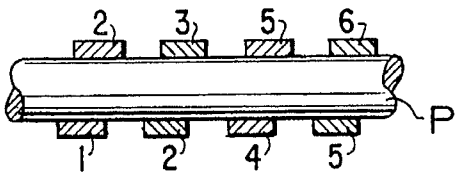
FIG. 16 is a section on line X—X of FIG. 13, perpendicular to the plane of the paper.

As was noted above with reference to FIG. 11, all of the pintle retaining loops in FIG. 16 are not only parallel within each set from fabric end A and fabric end B, but when the two sets are interdigitated, they are also canted in substantially the same direction relative to the central axis of the pintle, as a complete set. Thus again the crowding evident in FIG. 8 is eliminated, and interdigitation facilitated. There is now less discontinuity at the seam, thus reducing the propensity of this novel seam to mark the paper web being formed upon it. Seam marking is further reduced by producing relatively short pintle retaining loops using lengths of warp yarn that are no greater than the length of two and one-half repeats of the warp in the fabric. The high loop fill of this seam provides a smooth track through the pintle loops which allows for rapid insertion of the pintle during fabric installation.

In FIGS. 2, 6, 9 and 13, fabric weaves are shown in which the warps comprise flattened monofilaments. These yarns are preferred for use as warp strands in fabrics wherein a seam according to this invention is used. As can be seen from FIGS. 9 and 13, the flattened warps have a substantially rectangular cross section, with the long axis of the rectangle extending parallel to the plane of the fabric. When a flattened monofilament is used in an asymmetric fabric such as is shown for example in FIG. 13, the yarn must be twisted about its axis by 180° in order to maintain the required crimp pattern when forming the pintle retaining loops of the seam. This is also the case for a substantially round monofilament, although the twist is not then so visible.

The novel features of the high loop fill, woven back pin seam disclosed herein provide several advantages over pin seams of the prior art:

1) It is now possible to manufacture a high strength, high loop fill pin seam in a woven fabric. The invention has particular suitability in 3-shed woven fabric designs, or integral multiples thereof, such as 6-shed or 9-shed weaves, which utilize more than 50% of the available warp yarns from the opposing fabric ends to form the seam.

2) The time required for joining the ends containing this novel seam is reduced because the opposite "S" and "Z" orientations of the pintle retaining loops on the opposing fabric ends allows the loops to be quickly and easily aligned and interdigitated, and provides an open pintle receiving channel, thereby speeding installation on a paper making machine.

3) The propensity for seam marking of the web is now reduced as a consequence of the alignment of the pintle retaining loops, their high loop density, and their short loop length.

Those skilled in the art will readily realize that the foregoing examples of specific embodiments of this invention, as utilized in a 3-shed and 6-shed woven fabric, have so fully revealed its general nature that others may adapt these concepts to other embodiments without departing from the spirit of the invention and the scope of the appended claims. Therefore, such adaptations should and are intended to be comprehended within the meaning of this disclosure. The phraseology and terminology employed herein is used for purposes of description and not of limitation.

I claim:

1. A woven dryer fabric, for use in the dryer section of a paper making machine, said fabric having a first and second end which are joined by a pin seam including a pintle and pintle retaining loops, wherein in the fabric:

a) the warp yarns are polymeric monofilaments woven at a warp fill of from about 80% to about 120%; and b) the warp yarns from which the pintle retaining loops are formed at said first and second fabric ends are located in the fabric so that their preset crimp is maintained in registration with that of the fabric weave pattern;

and further wherein in the pin seam:

i) the pintle retaining loops have a loop fill greater than 50%;

ii) the pintle retaining loops are each formed from a length of warp yarn which is no greater than two and one-half repeats of the fabric weave;

iii) the pintle retaining loops on said first fabric end have an "S" orientation; and iv) the pintle retaining loops on said second fabric end have a "Z" orientation.

2. A dryer fabric according to claim 1, wherein the fabric is a 3-shed weave, and the loop fill is 66⅔%.

3. A fabric according to claim 2, wherein the weave design is an integral multiple of 3-sheds, and the loop fill is 66⅔%.

4. A fabric according to claim 1 wherein the pintle loops comprise monofilaments having a rectangular cross-section whose long axis extends substantially parallel to the axis of the pintle.

5. A fabric according to claim 4 wherein in at least some of the pintle retaining loops the warp yarns have a 180° twist.

6. A fabric according to claim 1 including a plurality of weft layers.

* * * * *